US005174722A

United States Patent [19]

Lybecker

[11] Patent Number: 5,174,722

[45] Date of Patent: Dec. 29, 1992

[54] SAFETY SHUTDOWN CIRCUIT FOR PNEUMATIC PUMP SYSTEM

[75] Inventor: Robert W. Lybecker, Kerrville. Tex.

[73] Assignee: Bomar Corporation, Kerrville. Tex.

[21] Appl. No.: 742,742

[22] Filed: Aug. 9, 1991

[51] Int. Cl.[5] ..... F04B 49/02

[52] U.S. Cl. ..... 417/9; 417/12; 417/46; 417/403; 91/221; 91/247

[58] Field of Search ..... 417/12. 46, 403. 404, 417/9; 91/220, 221. 247; 60/376, 403

[56] References Cited

U.S. PATENT DOCUMENTS

| | | | |
|---|---|---|---|
| 1,756,453 | 4/1930 | Davey et al. . | |
| 2,044,063 | 6/1936 | Dahlberg . | |
| 3,176,623 | 4/1965 | Howerton et al. | 417/46 X |
| 3,779,671 | 12/1973 | Lybecker et al. . | |
| 3,816,025 | 6/1974 | O'Neill | 417/9 X |
| 3,914,752 | 10/1975 | Howard et al. | 417/9 |
| 3,992,813 | 11/1976 | Freshel . | |
| 4,226,166 | 10/1980 | Frank | 60/403 X |
| 4,304,529 | 12/1981 | Gerich | 417/393 X |
| 4,333,827 | 6/1982 | Cummins. II | 417/46 X |
| 4,830,230 | 5/1989 | Powers | 417/403 X |
| 4,836,756 | 6/1989 | Fukumoto | 417/9 X |
| 4,934,598 | 6/1990 | Schnetzer et al. | 239/67 |

FOREIGN PATENT DOCUMENTS

| | | | |
|---|---|---|---|
| 56977 | 3/1989 | Japan | 417/9 |
| 2113773 | 8/1983 | United Kingdom . | |

*Primary Examiner*—Leonard E. Smith
*Attorney, Agent, or Firm*—Richard J. Smith

[57] ABSTRACT

A safety shutdown circuit for a pneumatic pump system. The pump system includes a manifold assembly for discharging pumped liquid. The liquid is discharged from the system by a reciprocating piston apparatus which drives a liquid pump cylinder. The pump system is provided with a pneumatic safety circuit for monitoring the stroke time or rate of the reciprocating air cylinder. The safety circuit includes a safety shutdown valve and a pneumatic timer associated with the shutdown valve. The pneumatic timer vents air supply within the safety circuit after a predetermined time interval. If a leak or failure occurs in the pump system, the reciprocating piston apparatus will complete a stroke in less time than the predetermined time as a result of the pressure loss incident to the leak or failure. In such event, the air supply within the safety circuit is directed through the shutdown valve to the pump system START valve to deactivate the system.

20 Claims, 5 Drawing Sheets

SAFETY SHUTDOWN CIRCUIT FOR PNEUMATIC PUMP SYSTEM

FIELD OF THE INVENTION

The present invention relates a safety shutdown circuit for a pneumatic pump system. More particularly, the present invention relates to a safety shutdown circuit which is especially adapted for automatically deactivating a pneumatic pump system in the event of a liquid leak or failure in the pump system.

BACKGROUND OF THE INVENTION

The pumping of expensive and valuable liquid into an object typically requires the close monitoring of the pump system to detect any leak or failure in the system to avoid the resulting loss of the expensive and valuable liquid. For example, in order to cure or prevent a tree disease known as oak wilt, a fungicide must be injected into the root system of a tree. The fungicide is typically injected through tubing and "T" shaped nozzles into the root system around the base of the tree. However, the fungicide associated with the treatment of oak wilt is quite expensive. Therefore, it is extremely important that the pump system be promptly stopped or deactivated in the event of a liquid leak. For example, it is extremely important that the system be stopped or deactivated in the event of a break in the tubing or dislodgment of one or more fittings from the tree during application of the fungicide. Also, it is desirable to automatically deactivate the system if the fungicide reservoir becomes empty.

In the absence of a system for automatically shutting down the pump system in the event of a leak or failure, the expensive fungicide must be applied at extremely low pressures and/or the pump system must be visually monitored during application of the fungicide to allow the pump system operator to manually deactivate the system in the event of a liquid leak or failure. These alternatives are time consuming and expensive and therefore extremely undesirable.

SUMMARY OF THE INVENTION

Accordingly, the present invention provides a pneumatic pump system including a safety shutdown circuit for deactivating the pump system in the event of a liquid leak or failure. Further, the present invention provides a method for automatically shutting down a pneumatic pump system in the event of a liquid leak or failure.

The apparatus of the present invention comprises a pneumatic pump cylinder and reciprocating piston apparatus for drawing liquid from an upstream location into a liquid pump cylinder as the piston apparatus is retracted and urging the liquid out of the liquid pump cylinder downstream as the piston apparatus is extended. The liquid may be urged into a manifold assembly for injecting the liquid into an object, such as the root system of a tree. The apparatus further comprises a pneumatic safety circuit for deactivating the pump system and piston apparatus if the period of time for the piston apparatus to travel a stroke from the retracted position to the extended position is less than a predetermined time interval. The predetermined time interval is selected so that the period of time for the piston apparatus to travel a stroke is less than the predetermined time interval in the event of a leak or failure in the pump system. The pneumatic safety circuit preferably includes apparatus for temporarily storing compressed air during the predetermined time interval and pneumatic timer apparatus for providing the predetermined time interval. The reciprocating piston apparatus may include a follower for alternately activating the appropriate reciprocating valves for extension and retraction of the piston apparatus.

The method for automatically deactivating the pneumatic pump system comprises the steps of activating the reciprocating piston apparatus associated with the liquid pump cylinder, drawing liquid into the pump cylinder as the piston apparatus is retracted and urging the liquid out of the pump cylinder as the piston apparatus is extended, temporarily storing compressed air during each stroke of the piston apparatus from the retracted position to the extended position, and deactivating the reciprocating piston apparatus if the amount of time for the piston apparatus to travel a stroke from the retracted position to the extended position is less than a predetermined period of time. The method for automatically deactivating the pneumatic pump system further comprises the step of venting the temporarily stored compressed air if the amount of time for the piston apparatus to travel a stroke from the retracted position to the extended position is more than the predetermined period of time.

When there is no leak or failure in the pump system and the liquid pump cylinder is properly pumping liquid therefrom, the piston apparatus moves at a generally constant rate or speed during each stroke from the fully retracted position to fully extended position. For example, when pumping liquid fungicide into a tree, the piston apparatus may move at a speed of approximately ten (10) seconds during each stroke from the fully retracted position to the fully extended position. However, should the manifold assembly tubing break or become disconnected from a manifold assembly fitting, or a fitting becomes disconnected or dislodged from the tree, or the liquid reservoir becomes empty, the piston apparatus moves at a faster speed from the fully retracted position to the fully extended position. For example, the piston apparatus may move from the fully retracted to fully extended position or condition in approximately two (2) seconds.

The safety shutdown circuit of the present invention resets or recocks during each cycle of the reciprocating piston apparatus when the piston apparatus is at its fully retracted position. When the safety shutdown circuit is reset, it temporarily stores compressed air over a predetermined time interval. The predetermined time interval is determined by the pneumatic timer apparatus which vents the temporarily stored compressed air to atmosphere at the end of the predetermined time interval if the piston apparatus has not completed its stroke. For example, if the safety circuit timer apparatus is set at six (6) seconds, and the piston apparatus moves from the fully retracted to fully extended position in more than six (6) seconds, the system assumes it to be operating properly and is not deactivated. However, if the piston apparatus moves at a rapid rate through a stroke, such as a rate of less than six (6) seconds, a failure is assumed to have occurred and the temporarily stored air is ported to the START valve to deactivate the pump system.

DETAILED DESCRIPTION OF THE PREFERRED EMBODIMENT

Figure 1:
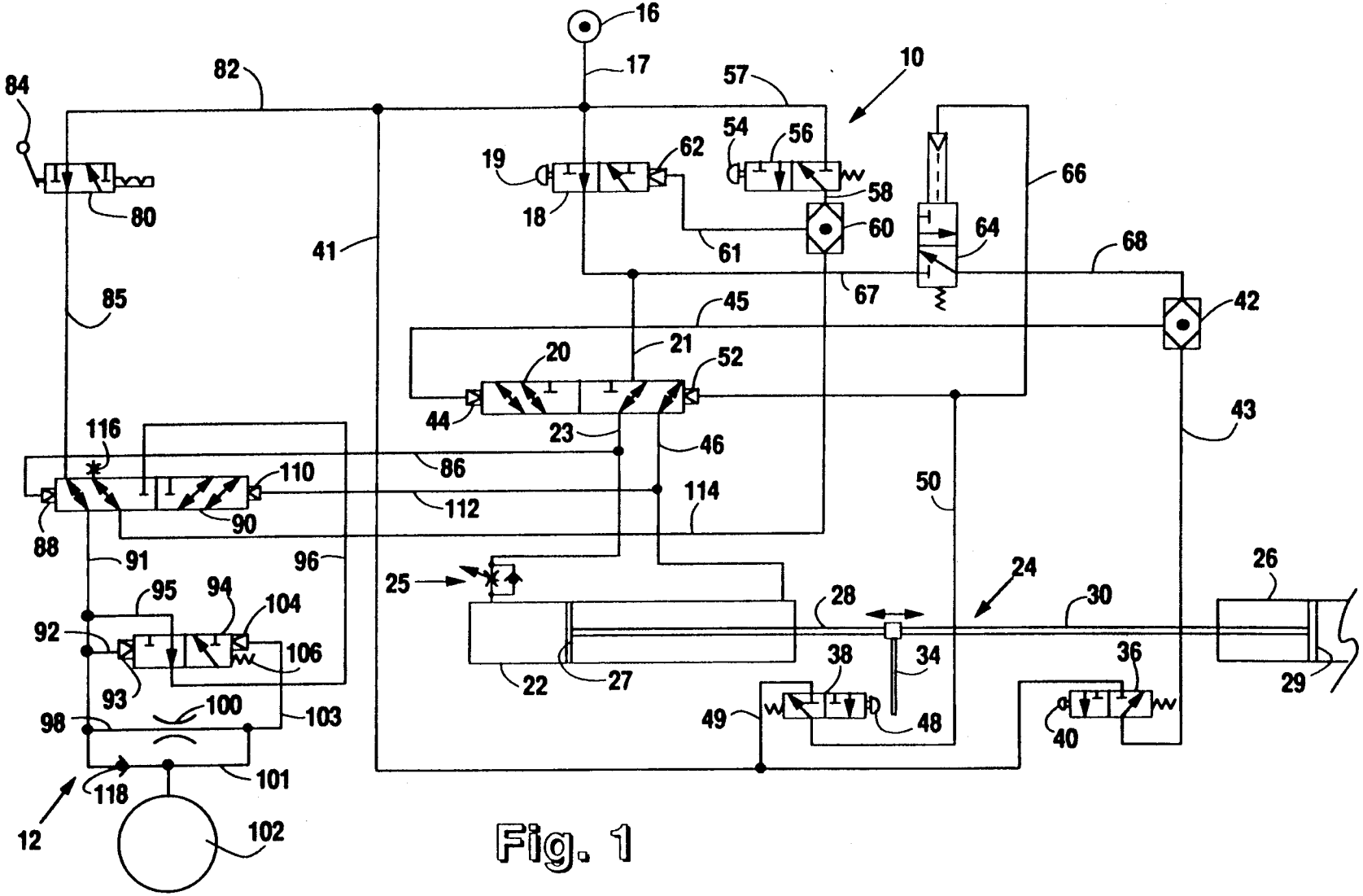
FIG. 1 is a schematic of the preferred embodiment of the pneumatic pump system and safety shutdown circuit of the present invention.
Figure 2:
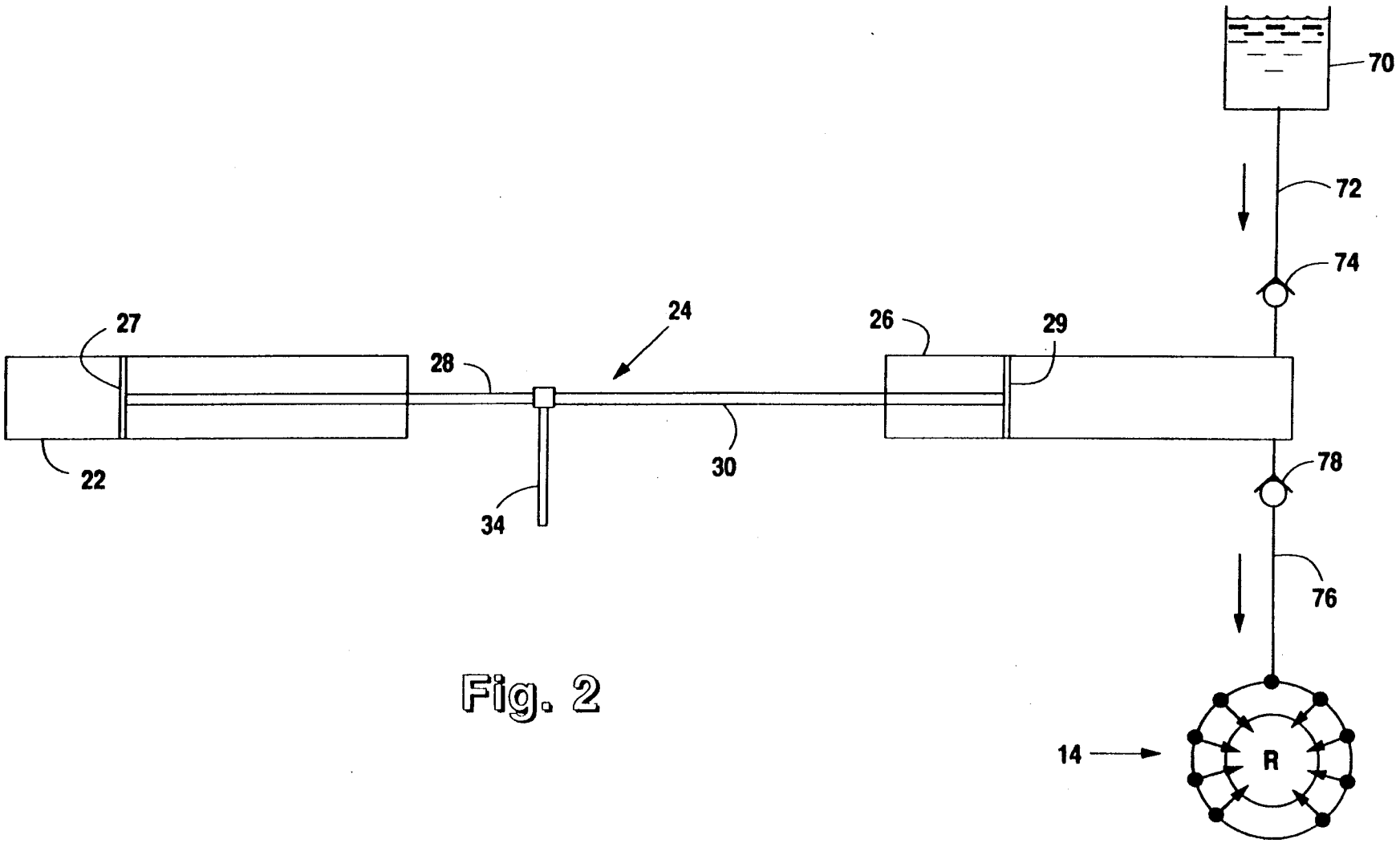
FIG. 2 is a representative drawing illustrating the pump apparatus, fluid reservoir, and manifold assembly of the present invention.

Referring to FIG. 1, a pneumatic pump system is identified by the number 10. The pump system 10 preferably includes a safety circuit 12 for automatically shutting down or deactivating the system 10 in the event of a system failure or liquid leak. As illustrated in FIG. 2, the pump system 10 may also include a manifold assembly 14 for discharging liquid into the roots of a tree R or other object. The safety circuit 12 and manifold assembly 14 are described in greater detail hereinbelow.

Referring again to FIG. 1, compressed air is supplied to the pump system 10 via an air supply 16 which is preferably a compressor source at approximately seventy (70) to ninety (90) pounds per square inch (psi). Air is supplied from the source 16 through a line or conduit 17 to a manually operated two position START valve 18. Line 17 is connected to air supply 16 and valve 18. Upon manual activation (depression) of the push button 19 connected to valve 18, compressed air is directed into main power valve 20 through line or conduit 21. Line 21 is connected to valve 18 and valve 20. Valve 20 is a four way, two position double air pilot valve. Air flows through the main valve 20 to a pneumatic pump cylinder 22 to either extend or retract reciprocating piston apparatus 24, depending upon the last position of valve 20. Air flows from valve 20 to cylinder 22 through a line or conduit 23 which is connected to valve 20 and cylinder 22 and through a flow control valve 25 associated with line 23. Flow control valve 25 permits free or unrestricted flow of air through conduit 23 into cylinder 22 when piston apparatus 24 is extending but controls or restricts the flow of air from cylinder 22 when piston apparatus 24 is retracting. The air path shown in FIG. 1 is such that the compressed air is flowing through line 23 and valve 25 to cylinder 22 such that the piston apparatus 24 is extending and thereby pumping liquid out of a liquid pump cylinder 26.

Figure 3:
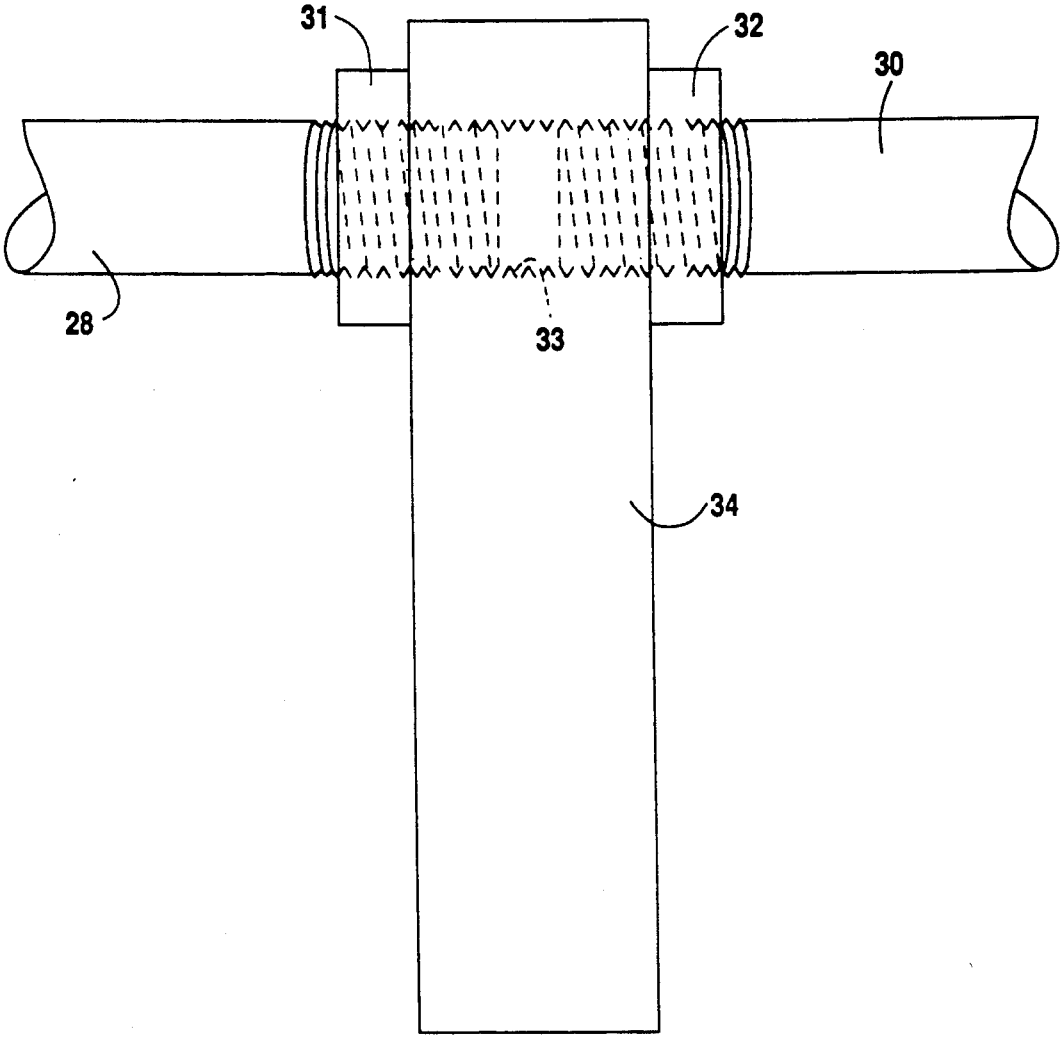
FIG. 3 is a partial side view of the preferred embodiment of the piston apparatus.

Referring to FIG. 2 and FIG. 3, the reciprocating piston apparatus 24 comprises a pneumatic pump piston 27 connected to a first cylinder rod 28 and a liquid pump piston 29 connected to a second cylinder rod 30. The ends of rods 28 and 30 are threaded through jam nuts 31 and 32, respectively, and threaded into an internally threaded passage 33 through a follower 34. The entire piston apparatus 24, including follower 34, reciprocates back and forth based on the routing of compressed air to cylinder 22. Follower 34 is preferably a metal bar or plate.

Referring again to FIG. 1, follower 34 is adapted to activate valves 36 and 38. Valves 36 and 38 each comprise a manually operated two position valve with a spring offset which, in the present invention, are operated by follower 34. When piston apparatus 24 reaches the fully extended position, follower 34 depresses operator 40 connected to valve 36. Depression of operator 40 allows compressed air from source 16 to flow through line or conduit 41 and through valve 36 to shuttle valve 42 through line or conduit 43 and from valve 42 to pneumatic air pilot operator 44 connected to main valve 20 through line or conduit 45. This reverses the porting within the main valve 20 such that air is supplied through line or conduit 46 to the retracting side of cylinder 22 and the extension side of cylinder 22 is vented to atmosphere. Line 46 is connected to valve 20 and cylinder 22. When the piston apparatus 24 reaches the fully retracted position, follower 34 depresses the operator 48 connected to valve 38 to cause or allow compressed air from air source 16 to flow through line 41 and line or conduit 49 and through valve 38 and line or conduit 50 to the pneumatic air pilot operator 52 connected to main valve 20 to again reverse the porting within the main valve 20.

It is to be understood that line 41 is connected to line 17 and valve 36 and that line 43 is connected to valve 36 and shuttle valve 42. Further, line 45 is connected to shuttle valve 42 and operator 44. It is also to be understood that line 49 is connected to line 41 and valve 38 and line 50 is connected to valve 38 and operator 52.

The operator of the pump system 10 may stop the system 10 manually at any time by depressing the push button 54 connected to STOP valve 56. Valve 56 is a manually operated two position valve with a spring offset. Depression of button 54 allows compressed air from air source 16 to flow through line or conduit 57, through valve 56, through line or conduit 58, through shuttle valve 60, and through line or conduit 61 to the pneumatic air pilot operator 62 connected to START valve 18. This repositions the porting on valve 18 such that the supply of air pressure from source 16 is blocked and the downstream circuit is vented to atmosphere.

It is to be understood that line 57 is connected to line 17 and valve 56 and that line 58 is connected to valve 56 and shuttle valve 60. Further, line 61 is connected to shuttle valve 60 and operator 62. It is also to be understood that valves 42 and 60 are shuttle valves with a pneumatic OR function.

Referring again to FIG. 1, the system 10 may be provided with a predetermining counter 64 for deactivating the system 10 once a predetermined number of complete cycles or strokes have been applied to pump cylinder 26. As air flows through the reversing valve 38, air pressure is applied to the counter 64 through line 50 and line or conduit 66 to count the number of cycles of pump cylinder 26. When the counter 64 reaches the preset number of strokes the system operator has selected, compressed air from line 21 is ported through line or conduit 67, through the counter 64, through line or conduit 68, through shuttle valve 42, and through line 45 to pressurize pneumatic operator 44 connected to valve 20. The pressure remains at the operator 44 to hold the air cylinder 22 in the fully retracted position until the counter 64 is reset by the system operator.

It is to be understood that line 66 is connected to line 50 and counter 64 and that line 67 is connected to line 21 and counter 64. Further, line 68 is connected to counter 64 and shuttle valve 42. It is also to be understood that pump cylinder 26 is a metering pump such that the system operator is able to determine the amount of liquid pumped by cylinder 26 for each full cycle of piston apparatus 24 from the fully retracted position to the fully extended position and back to the fully retracted position.

Referring to FIG. 2, the pump system 10 may be utilized for pumping liquid, such as liquid fungicide, from an upstream location and discharging the liquid downstream into an object, such as a tree root system R. A reservoir of liquid, such as fungicide, 70 is connected to pump cylinder 26 by a line or conduit 72 which is connected to and in fluid communication with reservoir 70 and cylinder 26. Line 72 has a one way inlet check valve 74 associated therewith for permitting the flow of liquid from reservoir 70 into pump cylinder 26 when piston apparatus 24 is being retracted within pump cylinder 26, as illustrated by the arrow in FIG. 2. That is, the retraction of piston apparatus 24 creates a vacuum within pump cylinder 26 so as to draw liquid from reservoir 70 through line 72 and check valve 74 into pump cylinder 26. However, the extension of piston apparatus 24 causes the liquid within pump cylinder 26 to be discharged from pump cylinder 26 through outlet line or conduit 76 and one way discharge check valve 78 associated with line 76, as illustrated by the arrow in FIG. 2. Line 76 is connected to and in fluid communication with pump cylinder 26 and manifold assembly 14. Manifold assembly 14 is utilized for injecting the liquid fungicide into the tree root system R, as described in greater detail hereinbelow.

Referring again to FIG. 1, the safety circuit 12 comprises a two position valve 80 which is connected to air supply 16 by a line or conduit 82. Valve 80 is a manually operated two position valve with detent and is shown as ON in FIG. 1. Line 82 is connected to line 41 and valve 80. The safety circuit 12 is armed or activated by depressing the lever 84 on valve 80, thereby providing compressed air to the circuit 12 through line or conduit 85. The arming of the safety circuit 12 is typically done after the START valve 18 of the pumping system 10 has been activated. When follower 34 depresses operator 48 on valve 38, air is supplied to operator 52 on valve 20, as discussed hereinabove. This shifts valve 20 such that the air pressure is applied through line 23 to extend piston apparatus 24. Concurrently, air pressure is applied to a timer start line or conduit 86, thereby providing compressed air to air pilot operator 88 on a safety shutdown valve 90. Valve 90 is a four way, two position double air pilot valve and line 86 is connected to line 23 and operator 88. Compressed air is also provided to safety shutdown valve 90 through line 85 which is connected to valve 80 and valve 90.

Upon activation of valve 80 and operator 88, compressed air flows through valve 90 and through line or conduit 91 and line or conduit 92 to pressurize the air pilot operator 93 on a timer valve 94. Valve 94 is a double pilot valve with spring offset. Line 92 is connected to operator 93 and line 91 and line 91 is connected to valve 90. Activation of operator 93 causes air to flow through a line or conduit 95 and valve 94 to pressurize a timer outlet line or conduit 96 which is connected to valve 94 and valve 90. Line 95 is connected to line 91 and valve 94. Air pressure is also applied through a line or conduit 98, connected to line 91, to a timing orifice 100 associated with line 98. Timing orifice 100 restricts the flow of air through line 98 into a line or conduit 101 which is connected to and in fluid communication with line 98 and a volume chamber 102. Orifice 100 also restricts the flow of air through line 98 into a line or conduit 103 which is connected to line 98 and an air pilot operator 104 on valve 94. Air pressure builds up within the volume chamber 102 over a predetermined time interval until the pressure at valve operator 104 essentially equals the pressure at valve operator 93. When the pressure at operator 104 essentially equals the pressure at operator 93, spring 106 associated with valve 94 shifts the porting on valve 94 such that the air supply is blocked and the air pressure within output supply line 96 is vented to atmosphere. That is, the volume of chamber 102 is selected such that a predetermined or preset period of time or time interval, such as six (6) seconds, is required for pressure at operator 104 to essentially equal pressure at operator 93. For example, if six (6) seconds is selected as the predetermined time interval, air pressure in the output supply line 96 will normally exist for six (6) seconds from the time operator 93 is pressurized. That is, compressed air is temporarily stored in line 96 of the safety circuit 12 during the predetermined time interval until the pressure at operator 104 is essentially equalized to the pressure at operator 93.

It is to be understood that the length of the predetermined time interval is determined by the size of the timing orifice and volume chamber. Further, timing orifice 100 preferably has a diameter of approximately four thousandths of an inch (0.004") and volume chamber 102 preferably has a capacity or volume of approximately one cubic inch (1 cu."), thereby providing a predetermined time interval of approximately six (6) seconds. However, it is to be understood that increasing the diameter of the timing orifice 100 would generally decrease the predetermined time interval while increasing the volume of chamber 102 would generally increase the predetermined time interval. The predetermined time interval may thus be varied by varying the size of timing orifice 100 or volume chamber 102.

Referring again to FIG. 1, valve 36 is operated by follower 34 when piston apparatus 24 reaches its fully extended position to reverse the direction of piston apparatus 24, as described hereinabove. Operator 44 shifts the porting on valve 20 such that the timer start line 86 is vented to atmosphere and air pressure from line 46 is applied to air pilot operator 110 on safety shutdown valve 90 through control signal line or conduit 112 which is connected to line 46 and operator 110. Pressurization of operator 110 shifts the porting of valve 90 so that output supply line 96 is connected to an output signal line or conduit 114 which is connected to valve 90 and shuttle valve 60. If air pressure is present in output supply line 96 at that time, compressed air is directed from line 96 through valve 90, through output signal line 114 and through shuttle valve 60 and line 61 to operator 62 on START valve 18, thereby stopping or deactivating the system 10 and piston apparatus 24. That is, if the predetermined time interval had not passed and line 96 had not yet vented to atmosphere, the piston apparatus 24 would be deactivated to stop the pumping of liquid. If air pressure is not present at the output supply line 96, no output signal is generated in line 114. That is, if the predetermined time interval had passed and line 96 had vented to atmosphere, the piston apparatus 24 continues to operate and pump liquid and is not deactivated.

It is to be understood that the time or duration for follower 34 to travel from operator 48 to operator 40 is the time or duration necessary to pump a portion of liquid from pump 26 and constitutes one stroke of the pump system 10. Further, the length of time for follower 34 to complete one such stroke is generally a function of the receptability of the root system R or other object for receiving the discharged liquid. In applying a fungicide to a tree root system R, the amount of time necessary to complete one such stroke is generally in the range of approximately ten (10) seconds to one (1) minute. Further, the stroke time for a particular application remains generally constant if there is no leak or failure in the system. However, in the event of a leak or failure upstream or downstream of liquid pump cylinder 26, such as a hole or leak in the manifold assembly 14, and as a result of the pressure decrease incident thereto, the time interval or duration for follower 34 to travel one stroke from operator 48 to operator 40 is much shorter, typically approximately two (2) seconds. Accordingly, when the time interval for one pump stroke is less than the predetermined time interval of the safety circuit 12, the pump system 10 will be deactivated as described hereinabove, thereby prohibiting any further pumping of the fluid from reservoir 70.

It is to be understood that when air pressure is applied to operator 110 on safety shutdown valve 90 through control signal line 112 as described hereinabove, the porting of valve 90 shifts so that output supply line 96 is connected to output signal line 114. Concurrently, the air supply to safety circuit 12 is vented to atmosphere through a restrictor or restrictor orifice 116 connected to valve 90. Since line 91 is connected to line 101, air flows from lines 103 and 101 and volume chamber 102 into line 91 through one way check valve 118 associated with line 91. Air also flows from lines 98, 92, and 95 into line 91 and from line 91 into valve 90 to be vented through restrictor 116. The function of restrictor 116 is to maintain pressure in the safety circuit 12 and output supply line 96 until a shutdown signal is affected at valve 18 in the event of a liquid leak or failure. If no leak or failure is present and no shutdown signal is affected, the pressure in safety circuit 12 eventually vents to atmospheric pressure so that the safety circuit 12 is ready to start the next timing cycle when valve 90 is shifted by the pressurization of operator 88. The sizing of restrictor 116 is preferably approximately thirteen thousandths of an inch (0.013") in diameter and is preferably selected to require approximately three (3) seconds to vent the safety circuit 12 to atmospheric pressure. As such, if no shutdown has occurred, the retraction of piston apparatus 24 into cylinder 22 must be controlled to require more than three (3) seconds, thereby allowing the safety circuit 12 to vent to atmospheric pressure before the next timing cycle begins with the depression of operator 48 by follower 34. The retraction time of piston apparatus 24 into cylinder 22 is controlled by adjustable flow control valve 25 which restricts the air flow from cylinder 22 into line 23 which, upon retraction of piston apparatus 24, is ported through valve 20 to atmosphere. When follower 34 depresses operator 48, the safety circuit 12 is reset or recocked, compressed air is again temporarily stored in circuit 12, and the predetermined time interval begins again. The safety circuit 12 thus temporarily stores compressed air during each stroke of piston apparatus 24 from its retracted position or condition to its extended position or condition. Further, when follower 34 depresses operator 48 and the safety circuit 12 is reset, compressed air is immediately stored in line 96 and the pressure at operator 104 begins to gradually increase.

Figure 4:
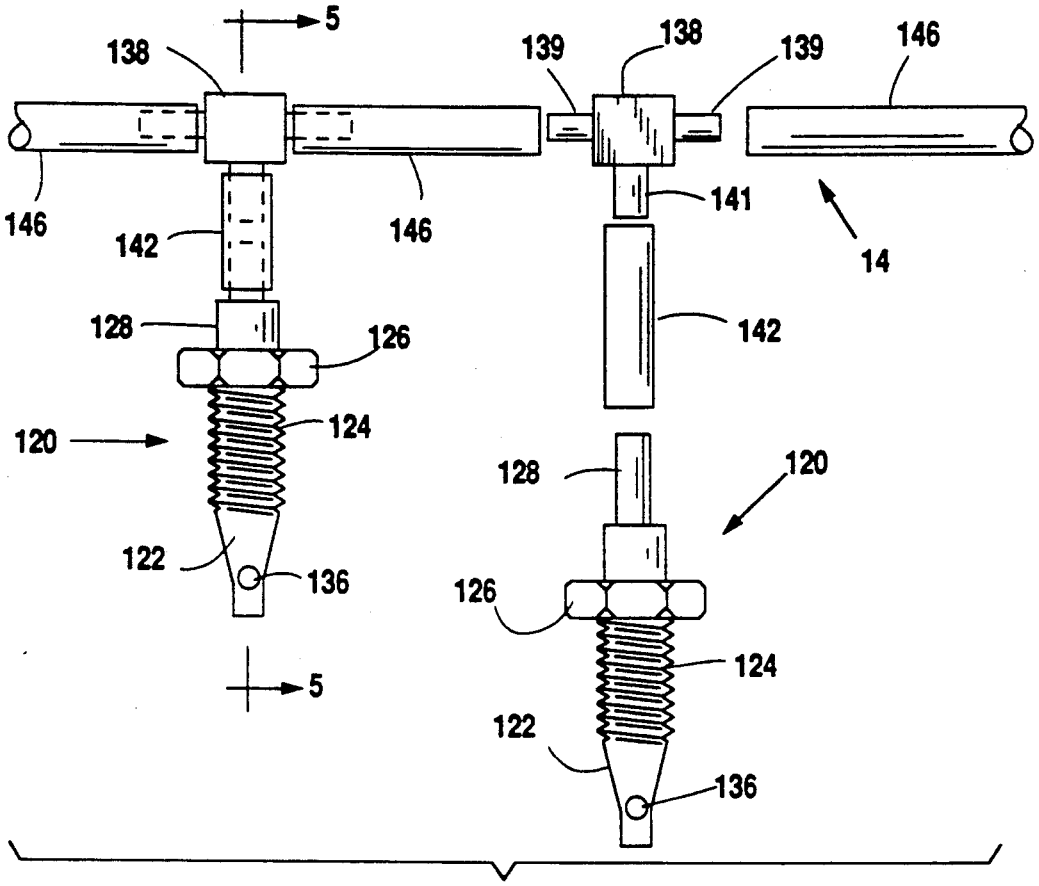
FIG. 4 is a partial exploded view of the preferred embodiment of the fittings and manifold assembly of the present invention.
Figure 5:
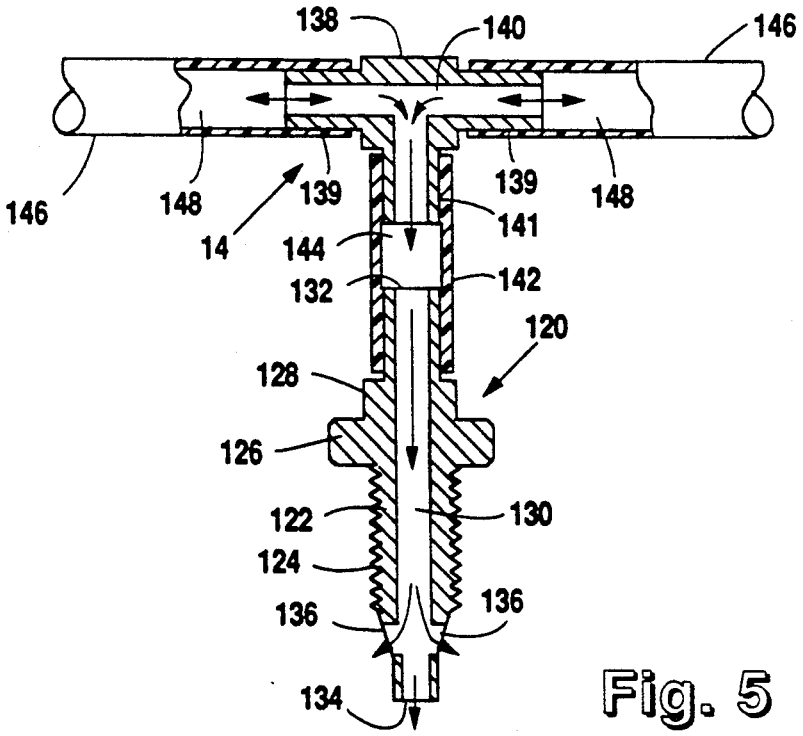
FIG. 5 is a cross sectional view of the preferred embodiment of the fitting and manifold assembly of the present invention taken along section lines 5—5 of FIG. 4.

Referring to FIG. 4 and FIG. 5, the manifold assembly 14 preferably comprises a plurality of fittings, each of which are identified by the number 120. Each fitting 120 comprises a nozzle 122 having an external, self tapping threads 124. Fitting 120 further comprises a head 126 and a connector 128. Head 126 is adapted to be received in and engaged by a conventional socket so as to rotate fitting 120. Each fitting 120 has a longitudinal passage 130 therethrough, an inlet port 132, a terminal outlet port 134, and a pair of radial outlet ports or passages 136.

Referring again to FIG. 4 and FIG. 5, the manifold assembly 14 further comprises a plurality of "T" shaped connector pieces 138, each having a passage 140 therethrough. Each connector piece 138 has a pair of arms 139 and a leg 141. The manifold assembly 14 further comprises a plurality of extension tubes 142, each of which have a passage 144 therethrough. One end of each extension tube 142 is connected to leg 141 of a connector 138 and the opposite end is adapted to be connected to connector 128 of a fitting 120. The manifold assembly 14 further comprises a plurality of connector tubes 146, each of which have a passage 148 therethrough. Each end of each connector tube 146 is adapted to be connected to an arm 139 of a connector 138.

Figure 6:
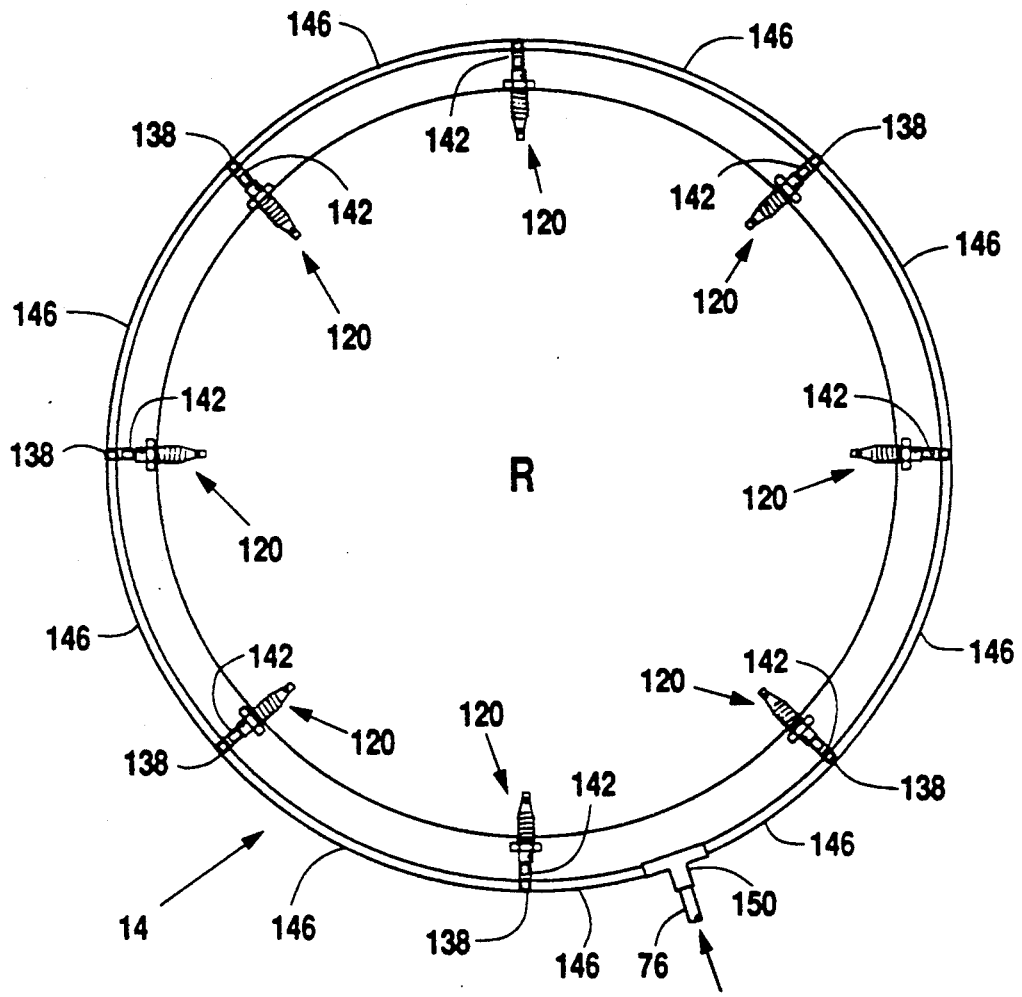
FIG. 6 is a diagram illustrating the usage of the preferred embodiment of the manifold assembly for injecting fungicide into the root system of a tree.

Referring to FIG. 6, the manifold assembly 14 may further comprise a master "T" shaped connector or injector fitting 150 having a passage therethrough. One end of the fitting 150 may be connected to conduit or tube 76 through which fungicide is applied to the manifold assembly 14, as illustrated by the arrow in FIG. 6. The other ends of connector 150 are each connected to a respective tube 146, the opposite end of which is connected to an arm 139 of a connector piece 138. Fungicide flows from the pump 26 through conduit 76 into fitting 150 and through fitting 150 into the tubes 146 on opposite sides of fitting 150. Each of the fittings 120 in the manifold assembly 14 are in fluid communication.

Referring again to FIG. 6, injecting trees with fungicide comprises the steps of rotating a plurality of fittings 120, such as by means of a conventional socket wrench, so as to thread the fittings 120 in the root system R of a tree, attaching the remainder of the assembly 14 to the fittings 120 by attaching the end of each extension tube 142 opposite leg 141 to a respective connector 128, and injecting fungicide into the assembly 14, thereby injecting the fungicide into the root system R of the tree through the fittings 120. Fungicide may be injected into the assembly 14 by the pump system 10 in the manner described hereinabove. Fungicide flows through the manifold assembly 14 and outward through ports 134 and 136 in the manner illustrated by the arrows in FIG. 5. After application or injection of the desired amount of fungicide, the fittings 120 are removed from the root system R. This may be accomplished by rotating the fittings, such as by means of a conventional socket wrench.

It is to be understood that an underside pilot or starter hole for each fitting 120 may first be drilled into the root system R and the respective fitting 120 thereafter inserted into the pilot hole prior to rotating the respective fitting 120. The threaded connection of the fittings 120 into the root system R allows the fungicide to be pumped at a pressure up to approximately one hundred (100) psi. Such increased pressure increases the rate at which the desired fungicide dosage can be applied to the tree. Further, the strong seal of the fittings 120 into the root system R in combination with the safety circuit 12 eliminates the need for the apparatus to be visually monitored during injection of the fungicide. However, in the event of a leak in the manifold assembly 14 or the dislodgment of a fitting 120 from the root system R, the safety circuit 12 will automatically deactivate the pump system 10 and stop the flow of fungicide into manifold assembly 14.

It is to be understood that each fitting 120 is connected to the remainder of the manifold assembly 14 by inserting connector 128 into passage 144 of a respective extension tube 142 in a press fit. The opposite end of extension tube 142 is connected to a respective connector 138 by inserting leg 141 into passage 144 in a press fit. Further, arms 139 are likewise inserted into the respective tube 146 by inserting arm 139 into the passage 148 of the respective tube 146 in a press fit. Each tube 146 adjacent to fitting 150 may likewise be connected to fitting 150 so as to permit fluid communication between fitting 150 and tubes 146. Further, the fungicide will flow through each of the tubes 146 and connectors 138 and into each of the fittings 120 and outward therefrom into the root system R.

It is to be understood that tubes 142 and 146 are preferably constructed of crimp resistant plastic tubing. Fittings 120 are preferably steel and connector pieces 138 are preferably plastic. It is also to be understood that passages 136 are at a right angle to passage 130 and that passages 136 and port 134 allow greater outflow of fungicide into the root system R than would simply be achieved simply by port 134.

It is to be understood that air source 16 and reservoir 70 may be connected to several pump systems 10. In such event, each pump system 10 would have its own manifold assembly 14 and one or more of the pump systems 10 would be provided with a safety circuit 12. As such, the liquid fungicide may be applied simultaneously to a plurality of trees.

While the safety shutdown circuit for pneumatic pump system of the present invention has been described in connection with the preferred embodiment, it is not intended to limit the invention to the particular form set forth, but on the contrary, it is intended to cover such alternatives, modifications, and equivalents as may be included within the spirit and scope of the invention as defined by the appended claims.

I claim:

1. A method for automatically deactivating a pump system, comprising the steps of:

activating a reciprocating piston apparatus associated with a pump cylinder;

drawing fluid into said pump cylinder and urging said fluid out of said pump cylinder;

temporarily storing compressed air as said piston apparatus travels a stroke; and deactivating said reciprocating piston apparatus if the amount of time for said piston apparatus to travel said stroke is less than a predetermined time interval.

2. A method for automatically deactivating a pump system, as recited in claim 1, further comprising the step of venting said temporarily stored compressed air if the amount of time for said piston apparatus to travel said stroke is more than said predetermined time interval.

3. A method for automatically deactivating a pneumatic pump system, comprising the steps of:

activating a reciprocating piston apparatus associated with a liquid pump cylinder, said piston apparatus being adapted to travel from a retracted position to an extended position;

drawing liquid into said liquid pump cylinder as said piston apparatus is retracted and urging said liquid out of said liquid pump cylinder as said piston apparatus is extended;

temporarily storing compressed air during each stroke of said piston apparatus from said retracted position to said extended position; and deactivating said reciprocating piston apparatus if the amount of time for said piston apparatus to travel a stroke from said retracted position to said extended position is less than a predetermined period of time.

4. A method for automatically deactivating a pneumatic pump system, as recited in claim 3, further comprising the step of venting said temporarily stored compressed air if the amount of time for said piston apparatus to travel a stroke from said retracted position to said extended position is more than said predetermined period of time.

5. A pneumatic pump system, comprising:

means for pumping liquid from an upstream location to a downstream location comprising a pneumatic pump cylinder and reciprocating piston apparatus for drawing said liquid into a liquid pump cylinder as said piston apparatus is retracted and urging said liquid out of said liquid pump cylinder as said piston apparatus is extended; and pneumatic circuit means for deactivating said piston apparatus if the period of time for said piston apparatus to travel a stroke from said retracted position to said extended position is less than a predetermined time interval, wherein said pneumatic circuit means comprises means for temporarily storing compressed air.

6. A pneumatic pump system, comprising:

means for pumping liquid from an upstream location to a downstream location, comprising a pneumatic pump cylinder and reciprocating piston apparatus for drawing said liquid into a liquid pump cylinder as said piston apparatus is retracted and urging said liquid out of said liquid pump cylinder as said piston apparatus is extended; and pneumatic circuit means for deactivating said piston apparatus if the period of time for said piston apparatus to travel a stroke from said retracted position to said extended position is less than a predetermined time interval, wherein said pneumatic circuit means comprises pneumatic timer means for determining said predetermined time interval.

7. A pneumatic pump system, comprising:

means for pumping liquid from an upstream location to a downstream location, comprising a pneumatic pump cylinder and reciprocating piston apparatus for drawing said liquid into a liquid pump cylinder as said piston apparatus is retracted and urging said liquid out of said liquid pump cylinder as said piston apparatus is extended; and pneumatic circuit means for deactivating said piston apparatus if the period of time for said piston apparatus to travel a stroke from said retracted position to said extended position is less than a predetermined time interval, wherein said pneumatic circuit means comprises pneumatic timer means for determining said predetermined time interval and wherein said pneumatic timer means comprises a timing orifice and volume chamber, said volume chamber being adapted to receive compressed air passing through said timing orifice.

8. A pneumatic pump system, comprising:

means for pumping liquid from an upstream location to a downstream location, comprising a pneumatic pump cylinder and a reciprocating piston apparatus for drawing said liquid into a liquid pump cylinder as said piston apparatus is retracted and urging said liquid out of said liquid pump cylinder as said piston apparatus is extended;

a manifold assembly for receiving said liquid downstream from said liquid pump cylinder; and pneumatic circuit means for temporarily storing compressed air, said pneumatic circuit means deactivating said piston apparatus if the period of time for said piston apparatus to travel a stroke from said retracted position to said extended position is less than a predetermined period of time.

9. A pneumatic pump system, comprising:

means for pumping liquid from an upstream location to a downstream location, comprising a pneumatic pump cylinder and reciprocating piston apparatus for drawing said liquid into a liquid pump cylinder as said piston apparatus is retracted and urging said liquid out of said liquid pump cylinder as said piston apparatus is extended; and pneumatic circuit means for deactivating said piston apparatus if the period of time for said piston apparatus to travel a stroke from said retracted position to said extended position is less than a time interval which is determined by selecting a capacity for compressed air storage means prior to activation of said system.

10. A pneumatic pump system, as recited in claim 1, further comprising a manifold assembly for receiving said liquid downstream from said liquid pump cylinder.

11. A pneumatic pump system, as recited in claim 1, wherein said reciprocating piston apparatus comprises a follower for alternately activating a piston apparatus retraction valve and a piston apparatus extension valve.

12. A pneumatic pump system, as recited in claim 1, further comprising a flow control valve for limiting the rate of retraction of said piston apparatus.

13. A pump system, comprising:

means for pumping fluid, comprising a reciprocating piston apparatus for drawing fluid into a pump cylinder and urging said fluid out of said pump cylinder; and pneumatic circuit means for deactivating said piston apparatus if the time period for said piston apparatus to travel a stroke is less than a time interval which is determined by selecting a capacity for compressed air storage means prior to activation of said system.

14. A pump system, as recited in claim 11, further comprising a manifold assembly for receiving said fluid downstream from said pump cylinder.

15. A pump system, as recited in claim 11, wherein said reciprocating piston apparatus comprises a follower for alternately activating a piston apparatus retraction valve and a piston apparatus extension valve.

16. A pump system, as recited in claim 11, further comprising a flow control valve for limiting the rate of retraction of said piston apparatus.

17. A pump system, comprising:

means for pumping fluid, comprising a reciprocating piston apparatus for drawing fluid into a pump cylinder and urging said fluid out of said pump cylinder; and pneumatic circuit means for deactivating said piston apparatus if the period of time for said piston apparatus to travel a stroke is less than a predetermined time interval, wherein said pneumatic circuit means comprises means for temporarily storing compressed air.

18. A pump system, as recited in claim 12, further comprising means for venting said temporarily stored compressed air.

19. A pump system, comprising:

means for pumping fluid, comprising a reciprocating piston apparatus for drawing fluid into a pump cylinder and urging said fluid out of said pump cylinder; and pneumatic circuit means for deactivating said piston apparatus if the period of time for said piston apparatus to travel a stroke is less than a predetermined time interval, wherein said pneumatic circuit means comprises pneumatic timer means for determining said predetermined time interval.

20. A pump system, as recited in claim 13, wherein said pneumatic timer means comprises a timing orifice and a volume chamber, said volume chamber being adapted to receive compressed air passing through said timing orifice.

* * * * *